United States Patent [19]

Carlson et al.

[11] Patent Number: 4,776,587

[45] Date of Patent: Oct. 11, 1988

[54] LEG EXERCISE MACHINE

[75] Inventors: Robert B. Carlson; Fredrick Wucherpfennig, both of Bloomington, Minn.

[73] Assignee: The Toro Company, Minneapolis, Minn.

[21] Appl. No.: 41,395

[22] Filed: Apr. 23, 1987

[51] Int. Cl.[4] ..... A63B 21/24

[52] U.S. Cl. ..... 272/129; 272/134; 272/145; 272/125; 128/25 B

[58] Field of Search ..... 272/118, 134, 144, 116, 272/117, 125, 129, 131, 145, 93 C, DIG. 4, DIG. 5, 122, 123; 128/25 R, 25 B; D21/195

[56] References Cited

U.S. PATENT DOCUMENTS

| | | | |
|---|---|---|---|
| D. 263,978 | 4/1982 | Brentham . | |
| 3,103,357 | 9/1963 | Berne . | |
| 3,285,070 | 11/1966 | McDonough | 272/125 X |
| 3,964,742 | 6/1976 | Carnielli | 128/25 R X |
| 4,125,258 | 11/1978 | McArthur | 272/118 |
| 4,200,279 | 4/1980 | Lambert, Jr. . | |
| 4,226,415 | 10/1980 | Wright | 272/DIG. 4 X |
| 4,256,302 | 3/1981 | Keiser et al. | 272/118 |
| 4,357,011 | 11/1982 | Voris | 272/118 |
| 4,429,871 | 2/1984 | Flechner | 272/134 X |
| 4,509,745 | 4/1985 | Angsten | 272/134 X |
| 4,628,910 | 12/1986 | Krukowski | 128/25 R |

FOREIGN PATENT DOCUMENTS 2045215 2/1971 France .

OTHER PUBLICATIONS

Nautilus Equipment Catalogue CM-130, p. 3.
Kettler-Sport Exclusiv '85 catalog, p. 12.
Delta Fitness Equipment brochure entitled "A New Generation of Fitness".
Cybex leaflet 3A010 entitled "Orthotron KT1 & KT2".
Hydra-Fitness Industries brochure entitled "Omnikinetics: 21st Century Conditioning . . . Today!", p. 5.
Universal Physical Conditioning Equipment 1984 Catalog, p. 21.
Paramount leaflet entitled "The Science of Conditioning".
Leaflet entitled "The LIDO 2.0 Rehabilitation System" by Loredan Biomedical.
Brochure entitled "KIN-COM: The Most Complete System for Muscle Testing and Rehabilitation" by Chattecx Corporation.
Leaflet entitled "The Biokinetic Knee Table", by Biokinetic Fitness Laboratories, Inc.
Brochure entitled "Biodex: One Comprehensive System for Muscle Testing and Rehabilitation" by Biodex Corporation.
Leaflet entitled "Sooner or Later, Every Rehabilitation Clinic Will Be Using Eric" by ComputAbility Corporation.
Brochure entitled "Experience Weightlessness" by The Toro Company.
Brochure entitled "What would rehab and sports . . . hydraulic cylinders?" by The Toro Company.
Leaflet entitled "Save Shoulders, Elbows and $22,000" by The Toro Company.
U.S. utility application entitled: "Exercise Machine," Ser. No. 675,366, filed 11/27/84.
U.S. utility application entitled: "Shoulder and Arm Exercise Machine," Ser. No. 041,396, filed 4/23/87.
U.S. design application entitled: "Shoulder and Arm Exercise Machine," Ser. No. 041,577, filed 4/23/87.
U.S. design application entitled: "Leg Exercise Machine," Ser. No. 041,578, filed 4/23/87.

*Primary Examiner*—Richard J. Apley
*Assistant Examiner*—Howard Flaxman
*Attorney, Agent, or Firm*—R. Lawrence Buckley

[57] ABSTRACT

A leg exercise machine (10) for bilateral and unilateral leg exercising. Machine (10) preferably includes an electromagnetic brake unit (44) coupled to a side-mounted exercise arm (68) through a planetary drive assembly (51). A longitudinally-adjustable leg pad support (70) is slidably mounted on exercise arm (68). Leg pad support (70) can carry a long rod (78) suitable for supporting a pair of leg pad assemblies (84) or a short rod (93) suitable for carrying a single leg pad assembly (84), depending on whether bilateral or unilateral exercising, respectively, is desired. Rods (78, 93) are sufficiently long to allow for lateral play in the leg pad assemblies (84) relative to the exercise arm (68) so as to accommodate various hip widths and so as not to create a side load on the knees during flexion and extension.

8 Claims, 5 Drawing Sheets

LEG EXERCISE MACHINE

TECHNICAL FIELD

The present invention generally relates to leg exercise machines. More specifically, the invention relates to leg exercise machines which include means for applying resistance to knee flexion and extension.

BACKGROUND OF THE INVENTION

The health benefits of a well-rounded exercise program have become increasingly well known in recent years, and various exercise machines have been developed. For aerobic exercising, such machines include stationary bicycles, treadmills, rowing machines, cross country skiing machines and the like. Similarly, many devices have been developed to exercise muscle groups anaerobically. The most traditional of these is the free-standing barbell or weight set. In addition, however, various machines have been developed for use in gyms, such as the Universal weight machines or the machines embodied in the Nautilus system.

Exercise machines can generally be categorized according to the technique by which resistance is provided. The Universal and Nautilus systems use weight stacks and a simple chain or cable connection to an exercise arm or lever which is manipulated by the exercising individual. Other resistance providing techniques are frictional clutches; hydraulic or pneumatic piston assemblies; springs, either metal coil or elastomeric; and electromagnetic brakes. An example of the latter type is described in commonly-owned U.S. patent application Ser. No. 675,366, filed Nov. 27, 1984, incorporated herein by reference.

Exercise machines can also be categorized according to the type of resistance provided, i.e. isotonic, isometric, isokinetic, variable resistance, concentric, eccentric, and so on.

Still another way to categorize exercise machines is based on the particular muscle group, limb, or joint being exercised. As is well known, there are multistation machines which can be used to exercise several different muscle groups and there are single station machines which are specifically designed to exercise a single joint or a single muscle group. The present invention is particularly directed to a knee extension/flexion machine which in its preferred form is a single station machine. However, those skilled in the art will recognize that the leg or knee exercise machine of the present invention could equally as well be incorporated into a multistation machine.

Although the preferred design of a leg exercise machine may vary depending on the intended application, i.e. light duty exercise, heavy duty exercise, or therapy, Applicants perceive that some features would be generally useful regardless of the intended application. Among the desirable features is means for bilateral (two leg) and unilateral (one leg) exercising. Following an injury and the predictable muscle atrophy and range of motion loss, for example, it is often necessary to exercise only the damaged limb so as to increase its diminished strength and flexibility. In this case, unilateral leg or knee exercise is preferred. However, for general exercising of the quadriceps and hamstrings, bilateral exercising is preferred.

Preferred leg exercise machines also provide resistance to leg flexion and extension so that the individual can exercise the hamstrings and quadriceps, respectively, on a single machine during a single "set". Since the quadriceps are usually considerably stronger than the hamstrings, and require greater resistance for useful exercise, the flexion resistance and extension resistance should preferably be individually adjustable.

Further with regard to the adjustability of a preferred leg machine, the pads, rollers, or cuffs which contact the user's legs should be longitudinally adjustable (parallel to the user's lower legs, in the user's midsaggital plane) so as to contact their shins immediately above the ankles. Such adjustment is provided for the sake of comfort and to insure consistency and reproducibility from person-to-person and from time-to-time.

In addition, Applicants have discovered that there should be controlled lateral (perpendicular to the midsaggital plane) adjustment or play in the leg cuffs, pads or rollers to accommodate various hip widths and so as to not apply an uncomfortable lateral force to the exercising individual's knee during extension or contraction.

Of course, a preferred knee flexion and extension machine should be very easy to use in terms of its controls and set up and in terms of mounting and dismounting the machine. And, preferred leg exercise machines should relatively be compact; unobtrusive; quiet; easy to maintain; and accurate. The latter requirement is particularly important in therapy applications wherein it is desirable to control the torque on the patient's knee to within roughly one foot-pound.

The prior art includes a wide variety of leg exercise machines. While these machines are generally useful for their intended purposes, they each possess shortcomings. One very simple bilateral leg extension exercise machine is shown in FIG. 4 of U.S. Pat. No. 4,200,279, issued to L. J. Lambert, Jr. This type of leg extension machine has an "exercise arm" centrally located between the individual's legs, within their imaginary midsaggital plane. The exercise arm pivotally attaches to the machine frame, and a combination chain/cable transmission connects the exercise arm to a stack of weights. This type of machine is admittedly very simple and straight-forward, but it provides exercise only for the quadriceps. Further, the user is put to the inconvenience of climbing over the central exercise arm before and after the set. Also, the chain-and-cable mechanical transmission from the exercise arm to the weight stack is quite noisy and requires considerable maintenance, e.g., chain tightening and lubrication.

Another weight-stack leg extension machine is sold by Nautilus Sports/Medical Industries, Inc., DeLand, Fla. The Nautilus leg extension machine is easier to mount and use than the Lambert machine since the Nautilus exercise arm is located to one side of the individual (and pivots in a saggital plane other than the midsaggital plane), and the leg pad or roller is perpendicular to the exercise arm and extends laterally across the individual's shins. However, as in the case of the Lambert machine, the Nautilus machine exercises the knee joint in extension only and the individual is forced to use a separate leg curl machine to exercise his hamstrings. Further, neither the Nautilus machine nor the Lambert machine includes leg pads which are longitudinally adjustable (in the user's midsaggital plane) to accommodate a variety of lower leg lengths.

Still another type of simple weight stack machine is represented by the Family Fitness Center 7497-000 machine manufactured by Kettler-Sport, Heinz Kettler, Metallwarenfabrik Gmbtt & Co., D-4763, Ense-Parsit.

This machine, however, unlike the simple weight stack machines described above, is a combination leg extension and leg flexion machine, wherein there are actually two interconnected midsaggital exercise arms set roughly at right angles to one another, one exercise arm for leg extension and one exercise arm for leg flexion or curl. While this sort of combination machine is useful for its intended purpose, it is incapable of exercising the hamstrings and quadriceps in a single "set". That is, with the Kettler-Sport type of machine the individual would have to first exercise his quadriceps using one of the exercise arms; and then switch positions and exercise his hamstrings using the other exercise arm.

Combination extension/curl machines are indeed represented in the prior art, but such machines are lacking in other areas. For example, Delta Fitness Equipment, Janesville, Wis., sells such a machine and a conceptually similar machine is shown in U.S. Design Pat. No. 263,978, issued to J. D. Brentham. These machines include a single central exercise arm which is coupled to a hydraulic or pneumatic cylinder. Mounted on the free end of the exercise arm are four rollers, one pair of rollers extending laterally from each side of the exercise arm substantially perpendicular to the user's midsaggital plane. The individual positions his legs on either side of the exercise arm such that each associated pair of rollers straddles one of the individual's lower legs. Then, when the individual extends his legs, his shins make contact with the front rollers, and when the individual contracts his legs, or flexes them, the rear rollers engage the backs of the individual's lower legs. While such machines indeed provide flexion and extension exercise, they too suffer from some disadvantages. For example, they include a central exercise arm which must be surmounted by the user before and after each exercise set. Also, the rollers do not fit snugly about the individual's legs so that there is always some lost motion between the individual's legs and the rollers at the top and bottom of the exercise arm stroke. Finally, such machines typically do not have individually-adjustable flexion and extension resistance, and such machines generally do not provide for bilateral and unilateral exercising.

Cybex, a division of Lumex Inc., Ronkonkoma, N.Y., sells an isokinetic machine for knee rehabilitation, injury prevention and performance training. The machine, designated Orthotron KT2, includes a pair of hydraulic dynamometers, one on either side of the user's chair. Each dynamometer has pivotally attached thereto an exercise arm which is strapped at its free end to one of the user's lower legs. This type of machine is preferable in that it does not include a cumbersome central exercise arm. Also, the Orthotron KT2 machine provides for bilateral or unilateral, flexion and/or extension exercise. However, this type of machine is awkward since each leg pad or cuff must be individually adjusted in length. And, two dynamometers are quite expensive. Moreover, this type of machine does not provide lateral play in the leg pads to allow for varying hip and thigh widths.

A device somewhat analogous to the Orthotron KT2 machine described above is sold by Hydra-Fitness Industries, Belton, Tex., under the designation "107/307 Uni-Lateral Quad/Hamstring". The Hydra-Fitness machine is advantageous in that some lateral play is allowed between the user's legs and the exercise arms, thus relieving lateral pressure on their knees. The Hydra-Fitness machine has two resistance units (hydraulic cylinders), however, and suffers from the "lost motion" problem discussed above in connection with the Delta and Brentham machines.

Some weight stack machines do include means for longitudinally adjusting the leg pads or cuffs. Universal Gym Equipment, Inc., Cedar Rapids, Iowa, and Cybex (Eagle Performance Systems by Cybex), Owatonna, Minnesota, sell such machines. Unfortunately, with these machines it is necessary to use separate leg extension and leg curl stations.

Finally, Paramount Fitness Equipment Corporation, Los Angeles, Calif., markets a CFS 1200 leg extension machine which allows some lateral freedom in that the user's legs are not rigidly held to an exercise arm using a strap or cuff; instead, the user's lower legs are laterally wedged between a pair of cushions. This lateral wedging, while providing some lateral play or give, can cause troublesome side thrust on the user's knees. Moreover, the CFS 1200 machine includes a cumbersome chain and sprocket transmission assembly connected to a central exercise arm which the user must straddle during use and surmount prior to and following an exercise set.

While the prior art leg exercise machines discussed above are generally effective for their intended purposes, it is clear that they have numerous disadvantages. The present invention addresses the problems possessed by prior art machines and includes, in preferred embodiments, many if not all of the desirable features outlined above. In particular, preferred leg exercise machines according to the invention allow for bilateral and unilateral, flexion and extension exercising; and are longitudinally and laterally adjustable; easy to use and maintain; compact; unobtrusive; quiet; and accurate.

SUMMARY OF THE INVENTION

Accordingly, in broad terms a leg exercise machine according to the invention includes a frame; a pair of leg pads; means operatively connected to the frame for providing leg exercise resistance; and means operatively connected to the resistance providing means for selectively carrying one or both of the leg pads, wherein when both of the leg pads are carried bilateral exercising is accommodated and when only one of the leg pads is carried the exercise machine is configured for unilateral exercising.

In a preferred embodiment, the resistance providing means includes an electromagnetic resistance unit having a stator fixed to the frame and a rotor rotatably coupled to the stator. The leg pad carrying means preferably includes an exercise arm extending from the electromagnetic resistance unit rotor; a leg pad support operatively connected to the exercise arm; and means for selectively operatively connecting the leg pads to the leg pad support.

The means for selectively operatively connecting the leg pads to the leg pad support preferably includes a long rod suitable for supporting both of the leg pads, for bilateral exercising; or a short rod, suitable for supporting one of the leg pads, for unilateral exercising. The rods slidably carry the leg pad or pads so that they can freely move laterally with respect to the exercise arm.

Also, in preferred machines the leg pads can be longitudinally adjusted to accommodate a variety of lower leg lengths. One preferred way to accomplish longitudinal adjustment is to provide a plurality of apertures in the exercise arm which can be selectively engaged by a spring-loaded pin carried by the leg pad support. To then longitudinally adjust the leg pad support, and the leg pads, it is simply necessary to withdraw the spring-loaded pin from one of the exercise arm apertures, relocate the leg pad support, and allow the spring-loaded pin to engage another one of the exercise arm apertures.

Another preferred feature is a planetary drive transmission between the exercise arm and the resistance unit, e.g., electromagnetic brake. The resistance unit in combination with the planetary drive transmission preferably provides up to 400 foot pounds of torque.

The invention is directed toward other preferred features, as further described below.

BRIEF DESCRIPTION OF THE DRAWINGS

The invention will be further described with reference to the Drawings, wherein:

FIG. 7 is a perspective partially exploded view of the planetary gear/brake unit of the exercise machine of FIG. 1.

DETAILED DESCRIPTION OF PREFERRED EMBODIMENT

Figure 1:
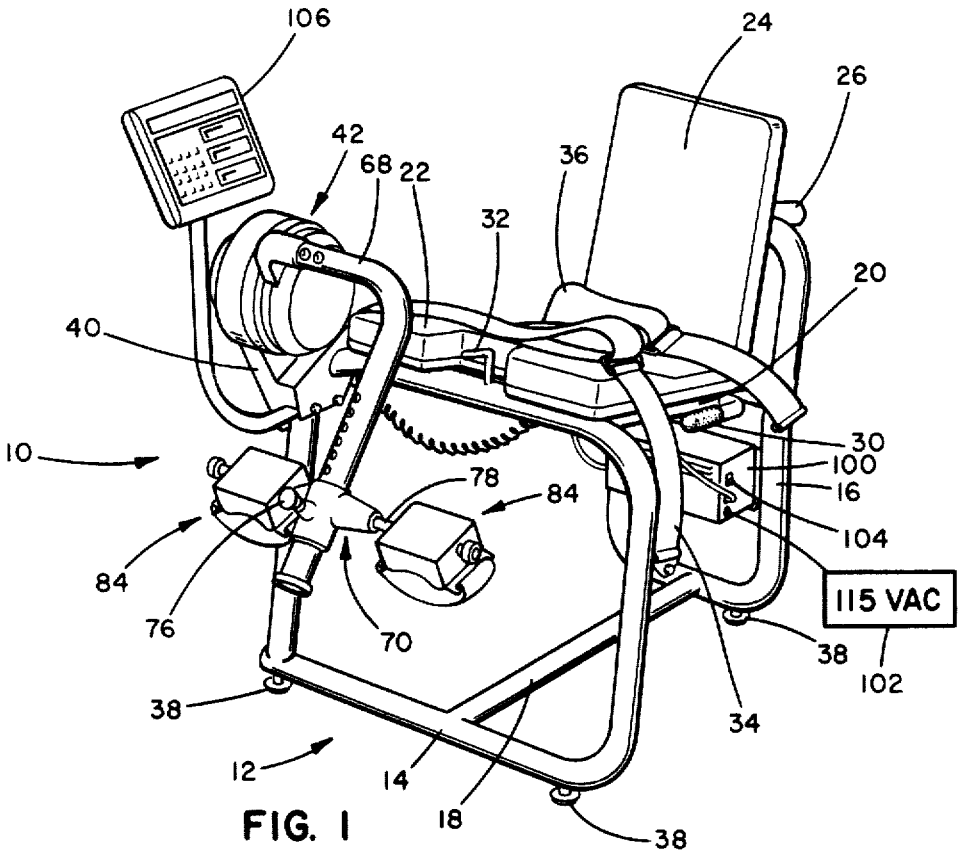
FIG. 1 is a perspective view of a preferred leg exercise machine according to the invention.
Figure 4:
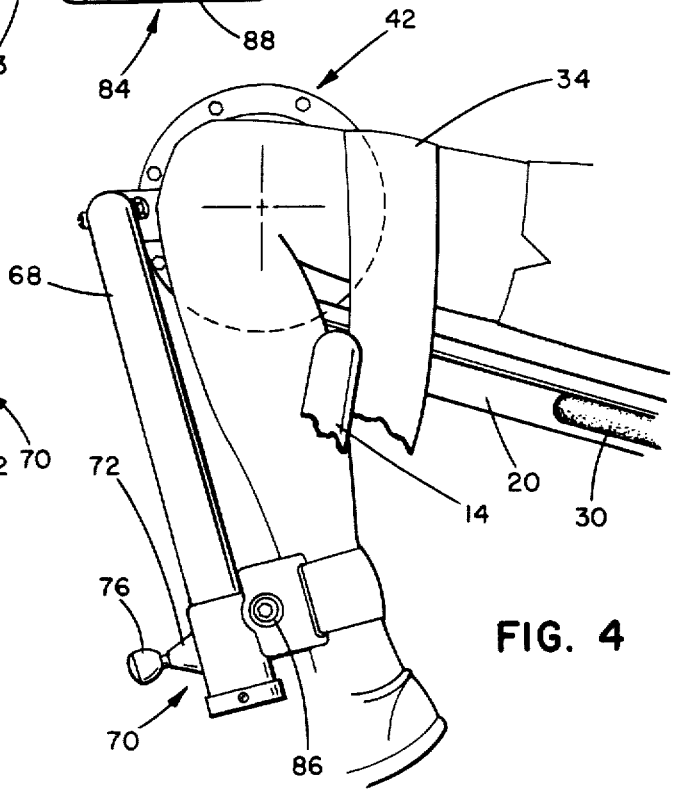
FIG. 4 is a partial side elevational view of the exercise machine of FIG. 1, showing an individual's legs strapped to the exercise arm.
Figure 8:
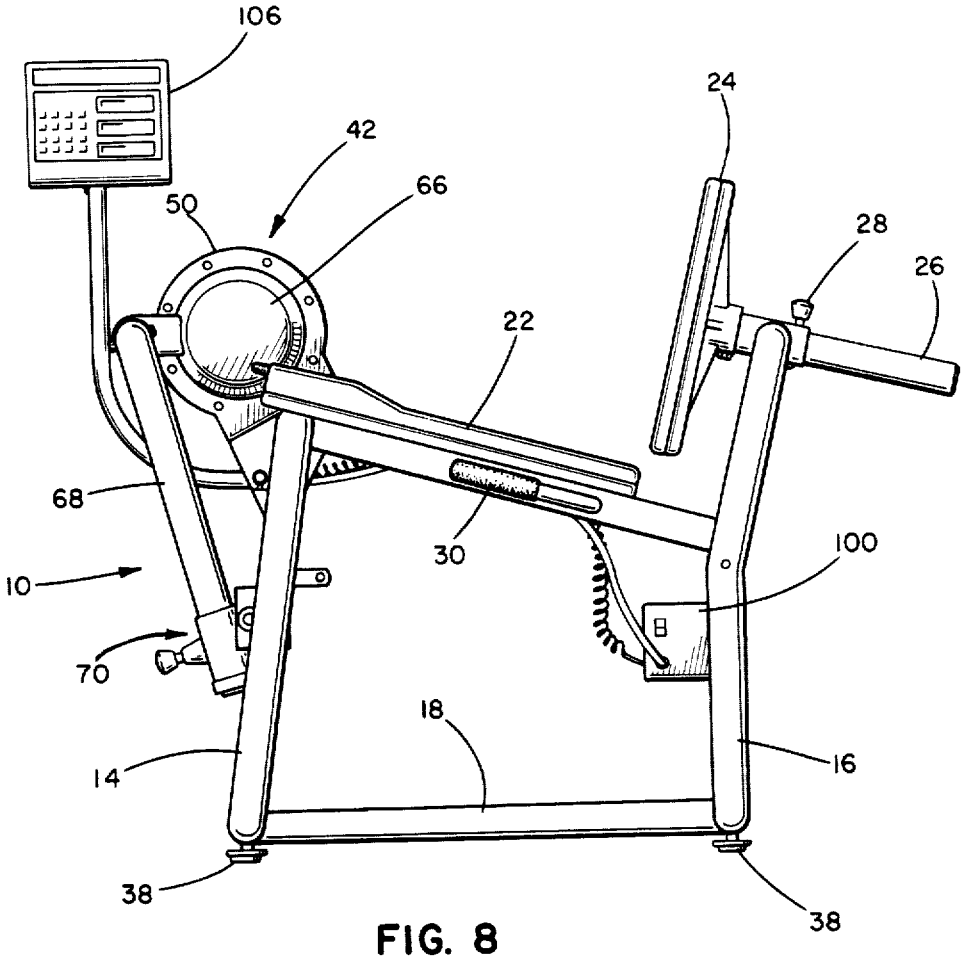
FIG. 8 is a side elevational view of the exercise machine of FIG. 1.

With reference to the Drawings, wherein like reference numerals designate like parts and assemblies throughout the several views, FIG. 1 shows a perspective view of a preferred leg exercise machine 10 according to the invention. Machine 10 includes a frame assembly 12 preferably made of two inch diameter heavy gauge steel tubing in nickel chrome and baked black powder enamel coating. Frame 12 includes a front substantially square-shaped subframe 14 and a rear substantially rectangular-shaped subframe 16. Each subframe 14, 16 includes a horizontal base member, a pair of vertical side members, and a horizontal top member. Spanning horizontally between the base members of subframes 14 and 16 is a lower spanner tube 18. A pair of parallel upper spanner angle irons 20 interconnect the horizontal top members of subframes 14 and 16 and support a substantially horizontal seat 22. A backrest 24 is also included. An apertured backrest adjustment tube 26 extends rearwardly from backrest 24 and is slidably received by an aperture formed at the uppermost end of rear subframe 16. A backrest adjustment pin 28, shown in FIG. 8, selectively engages the apertures in the adjustment tube 26 and locks the backrest adjustment tube 26 to rear subframe assembly 16. Pin 28 is pulled upward to disengage the backrest adjustment tube 26 from subframe 16. Backrest 24 can then be adjusted to the desired position and pin 28 reinserted to prevent further movement of backrest 24 relative to frame 12. Applicants perceive that an adjustable backrest is desirable to ensure that the users' knees align with the axis of rotation of the "resistance means" regardless of the users' heights and sizes. Proper alignment is shown in FIG. 4.

Figure 5:
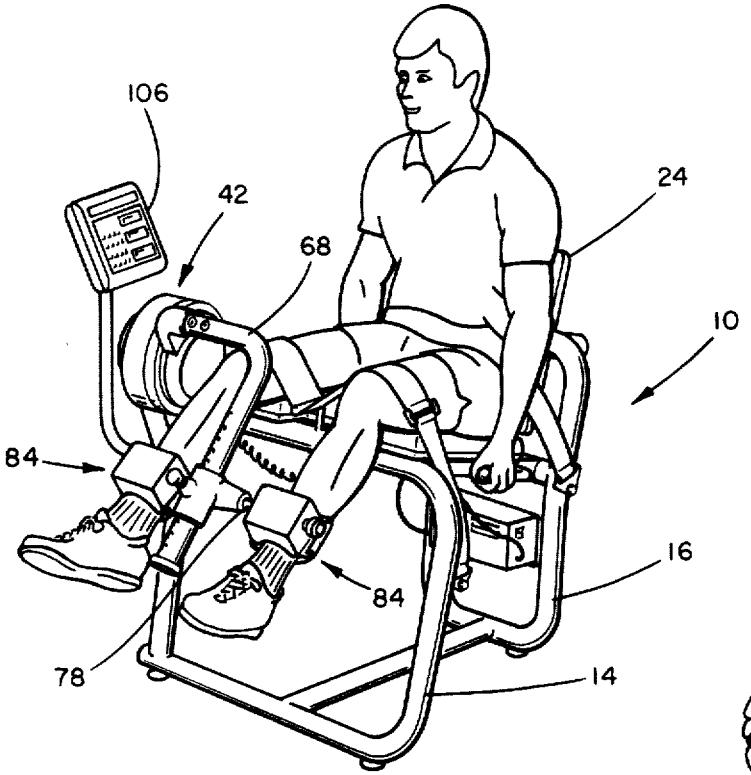
FIG. 5 is a perspective view of the leg exercise machine of FIG. 1 in use, showing an individual bilaterally exercising his legs.
Figure 6:
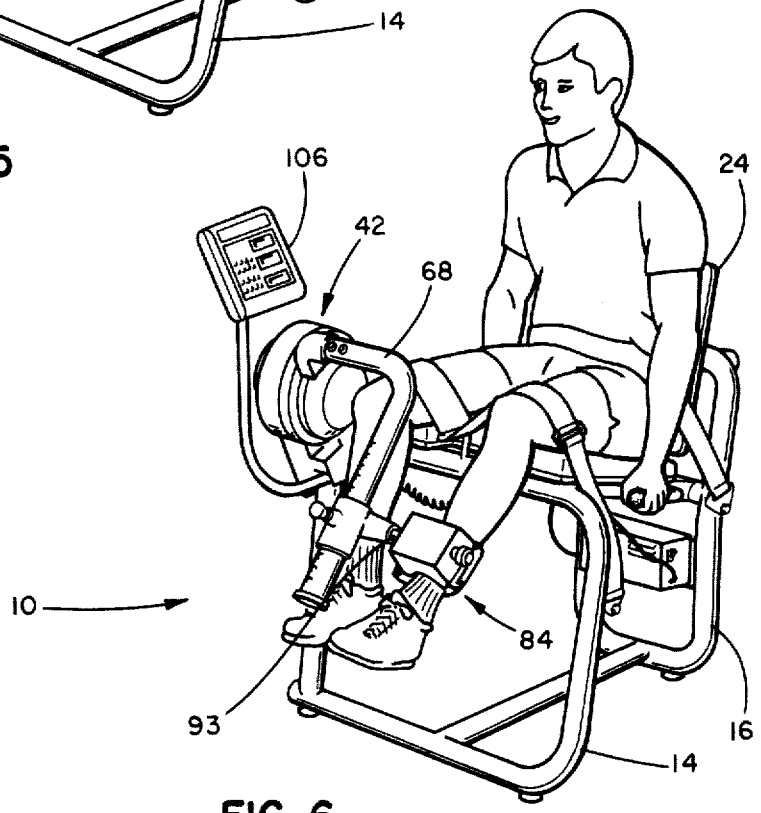
FIG. 6 is a perspective view of the leg exercise machine of FIG. 1, modified in accordance with FIG. 3B, showing an individual exercising one of his legs.
Figure 11:
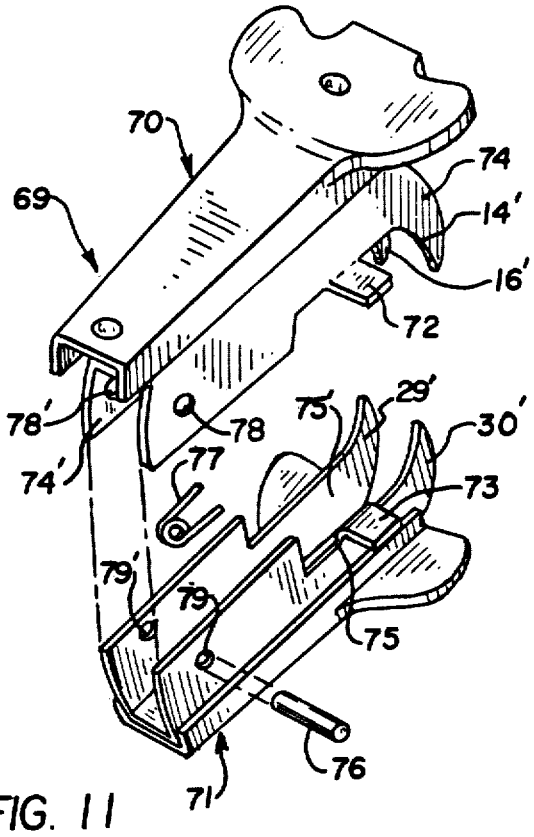
Figure 12:
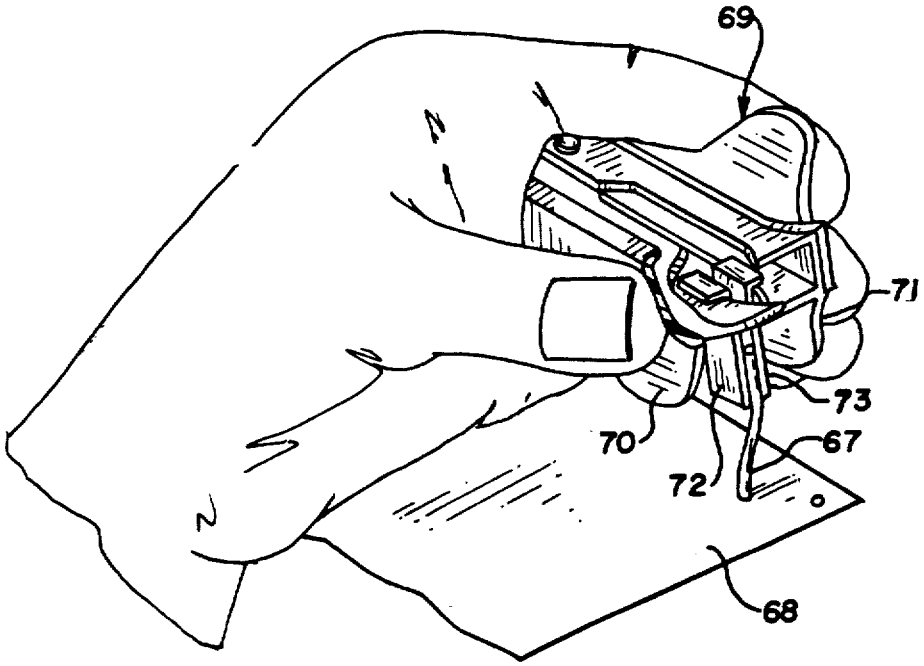

Extending laterally from each upper spanner angle iron 20 is a hand grip 30 suitable for use by the exercising individual (see FIGS. 5 and 6). Extending upwardly from the horizontal top member of front subframe 14 is a centrally-located inverted L-shaped strap loop 32, the function of which will be described below. Attached at either end to the vertical side members of front subframe 14 is a thigh stabilizing strap 34 which can include a buckle or a hook-and-loop connector, whereby the thighs can be firmly strapped into pressing engagement with the seat lower portion 22. As shown in FIGS. 5 and 6, strap loop 32 cooperates with thigh stabilizing strap 34 by holding down the central part of strap 34 between the user's legs so as to securely hold the individual's legs in a spaced apart substantially parallel arrangement. A hip stabilizing strap 36 attaches at either end to the vertical side members of rear subframe 16 and is suitable for wrapping around the user's waist and hips as shown in FIGS. 5 and 6. When straps 34 and 36 are in place as shown in the Drawings, the user is securely strapped down and against seat portions 22 and 24 so as to isolate the movement of the individual's knees to get the greatest benefit from the exercise.

Supporting the frame assembly 12 is a plurality of standard leveler legs 38 which are threadedly connected to the frame assembly 12 to allow for leveling of the entire machine 10.

Front subframe 14 carries at one upper corner thereof a split sheet metal brake mount 40 which in turn operatively supports a brake unit/planetary drive assembly 42, shown partially exploded in FIG. 7. Assembly 42 includes a 24 VDC, 1.7 amp electrically-operated magnetic particle brake 44 preferably of the type manufactured by Shinko Electric Co., Ltd., Japan, under the designation PRB-10A. Brake 44 includes a generally circular case 46 which is rigidly supported by brake mount 40. Brake case 46 has securely mounted therein the stator of the brake, as well known to those skilled in the art. Brake 44 also includes a movable portion or rotor 47 which is rotatably coupled to the brake case 46. Extending from the rotor 47 is an output shaft 48, the connection between the rotor 47 and the output shaft 48 being made using a key 49, or other conventional means. Output shaft 48 forms a part of or is connected to the armature or rotor 47 of brake 44 with the armature being surrounded in a known manner by electrical windings within case 46. When current flows through the windings, a magnetic field is generated which resists rotation of the armature 47. Thus, rotation of output shaft 48 will be resisted by a variable force that is directly dependent upon the current supply to the windings. The greater the amount of current, the greater the resistance to rotation, i.e. the greater the force against which the user exercises. The operation of brake 44 is further described below.

Bolted to brake case 46 is a ring gear 50 of conventional construction. Only one of the bolts is shown in FIG. 7 for the sake of clarity. Ring gear 50 has a pitch diameter of 8 inches and includes 12 teeth per inch. Gear 50 comprises a portion of a planetary gear drive 51 which ultimately couples the exercising individual's legs to the rotor 47 of electromagnetic brake 44. Fixed to output shaft 48 is a sun gear 52, a key 53 providing the connection therebetween. Sun gear 52 has a 2-inch pitch diameter and 12 teeth per inch. The "planets" of the planetary drive assembly are freely rotatably mounted on a substantially L-shaped gear carrier 56. Gear carrier 56 includes three coplanar lobes 55 which are circumferentially spaced at 120° intervals and which extend radially outward from a central hub. Also extending radially outward from the hub, coplanar with lobes 55, is a first extension 57. Attached to the far end of first extension 57, and extending perpendicular thereto and perpendicular to the plane containing lobes 55 and extension 57 is a second extension 69. Second extension 69 is apertured at its forwardmost end for the purpose explained below.

Extending rearwardly from lobes 55 of gear carrier 56 are three press fit planet gear shafts 58, each of which carries a roller bearing 59 and a freely rotating planet gear 60. For the sake of clarity, only one of the planet gears 60 is exploded away from gear carrier 56 in FIG. 7. Each planet gear has a pitch diameter of 3 inches and 12 teeth per inch. A pair of washers 61 also ride on shaft 58 and straddle planet gear 60, and a retaining ring 63 holds planet gear 60 and associated components on shaft 58. Gear carrier 56 forms a central aperture 65 which retains a pair of main cone bearings 62, one bearing 62 on the front side of carrier 56 and one bearing 62 on the rear side of carrier 56. The outer surfaces of bearings 62 contact bearing cups 67 while the inner surfaces rollably contact shaft 48. Completing the assembly, a lock nut 64 threads on the far end of output shaft 48 and a round cover 66 slotted to receive the first extension 57 of gear carrier 56 is screwed to the outer surface of the hub of gear carrier 56.

As well known to those skilled in the art of planetary gear drives, planet gears 60 mesh with sun gear 52 at their radially inward points and at their outer points mesh with the fixed ring gear 50. Thus, rotation of gear carrier 56 in a first direction relative to ring gear 50 causes rotation of planet gears 60 in the opposite direction and rotation of sun gear 52 in the first direction. The diameters of the gears are sized such that rotation of gear carrier 56 at X rpm results in a rotation of shaft 48 at 5X rpm. Thus, torque produced by brake unit 44 on output shaft 48 is multiplied by a factor of 5 at the gear carrier 56. Planetary drive 51, though preferably providing a 5X ratio, could generally provide anywhere from about 3X to 8X, and brake 44 could produce up to about 50 to 100 foot-pounds of torque. Assembly 42 could then provide up to about 150 to 800 foot-pounds to the exercise arm. In a preferred machine 10, however, brake unit 44 provides up to 80 foot-pounds of torque, and through the addition of planetary drive assembly 51 the entire assembly 42 is capable of providing up to 400 foot-pounds of torque, and is thus capable of applying a suitably wide range of isotonic resistance.

Extending horizontally from gear carrier 56, and connected to second extension 65, is an L-shaped exercise arm 68. As shown in FIG. 1, exercise arm 68 is preferably formed from round tubular metal and includes a relatively short leg aligned perpendicular to the exercising individual's midsaggital plane and a relatively long leg arranged substantially parallel to or lying within the individual's midsaggital plane. The short leg is apertured like second extension 69 of gear carrier 56, and a pair of threaded connectors are received by aligned apertures to connect the exercise arm 68 to the gear carrier 56. The longer leg of exercise arm 68 is apertured at regular intervals on its uppermost surface to allow for longitudinal adjustment of the foot pads as further described below.

Figure 2:
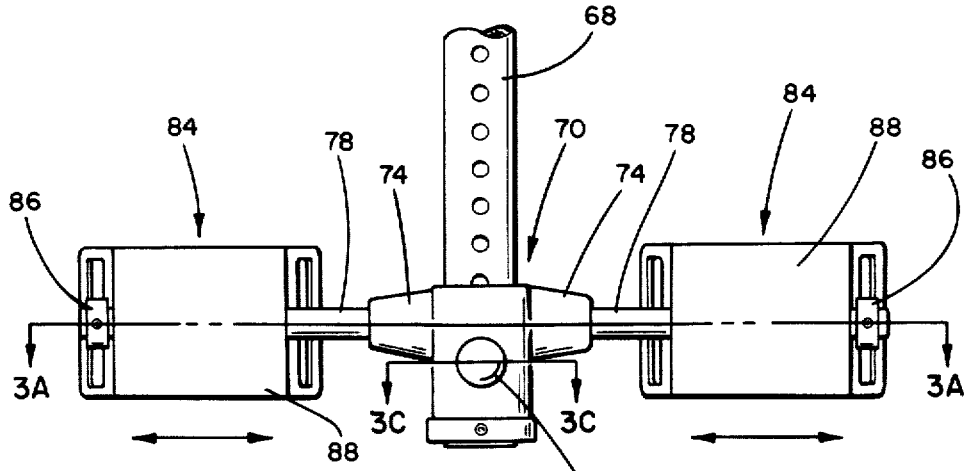
FIG. 2 is a front elevational view of the lower portion of the exercise arm of the exercise machine of FIG. 1.
Figure 3A:
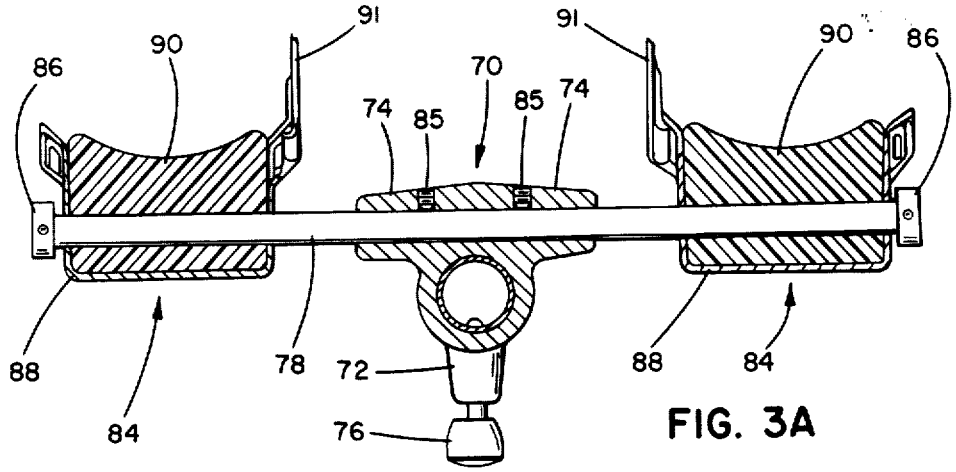
FIG. 3A is a sectional view taken substantially along line 3A—3A of FIG. 2.
Figure 3B:
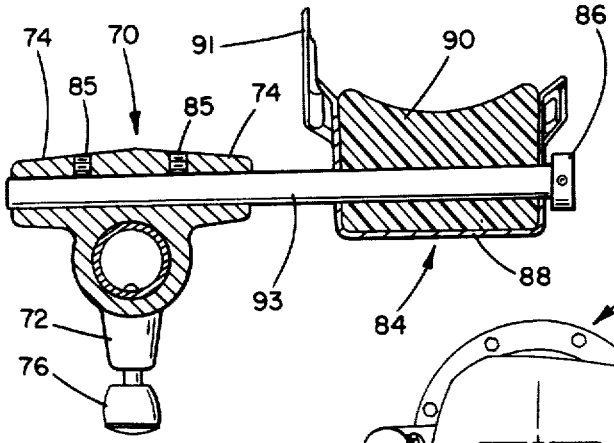
FIG. 3B is a sectional view much like FIG. 3A of a leg exercise machine according to the invention outfitted for unilateral exercising.
Figure 3C:
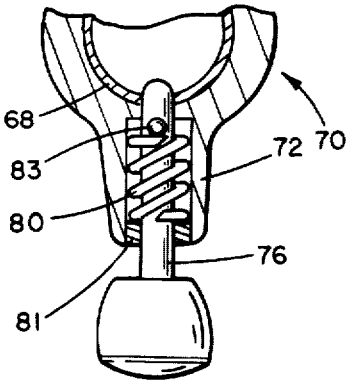
FIG. 3C is a partial sectional view taken substantially along line 3C—3C of FIG. 2.

A cast iron leg pad support 70 is slidably carried by exercise arm 68. FIG. 2 shows a front elevational view of the lower portion of exercise arm 68, including leg pad support 70, and sectional views of leg pad support 70 are shown in FIGS. 3A and 3C. Leg pad support 70 includes a central hub slidably mounted on exercise arm 68 and three bosses extending therefrom, a front boss 72 and a pair of side bosses 74. Front boss 72 is apertured to receive a spring-loaded pin 76, and side bosses 74 are apertured to receive a rod 78 or 93. Referring to FIG. 3C, boss 72 forms an aperture which receives pin 76, a compression spring 80, and a bushing 81, wherein bushing 81 is press fit into the aperture. The front end of extension spring 80 bears on the inner surface of bushing 81, and the rear end pushes against a roll pin 83 extending through pin 76. Thus, pin 76 is spring-biased inward toward exercise arm 68, and leg pad support 70 can be longitudinally adjusted along exercise arm 67 by withdrawing pin 76 against the force of spring 80, moving leg pad support 70 to a new longitudinal position and then allowing pin 76 to reinsert itself into another one of the apertures in exercise arm 68.

Rod 78 is fixed to leg support 70 through the use of a pair of socket head screws 85 which are threadedly received at the rear surfaces of side bosses 74. Rod 78 is preferably quite smooth and slidably carries a pair of leg pad assemblies 84 and, at the outer ends thereof, a pair of lock collars 86. Lock collars 86 are connected by set screws to the outer ends of rod 78 so as to prevent leg pad assemblies 84 from falling off rod 78. Each leg pad assembly 84 includes a sheet metal U-shaped member 88 which includes a pair of apertured side legs suitable for slidably receiving rod 78 or 93. Located between the side legs of U-shaped member 88 is a resilient foam pad 90 which is curved on its rear surface to comfortably bear against the individual's shin.

Attached to each U-shaped member 88 is a strap 91. As shown in FIGS. 4, 5 and 6, the individual straps his or her legs to the leg pad assemblies 84 using straps 91 which are preferably supplied with hook-and-loop connectors. It should be noted that long rod 78, as shown in FIGS. 2 and 3A, can be replaced by a shorter rod 93 capable of supporting only one of the leg pad assemblies 84. This configuration, shown in FIG. 3B, would be used for unilateral exercising. FIG. 6 shows use of a short rod 93 for unilateral exercising of an individual's left leg. Of course, rod 93 can be switched to the other side of support 70 to exercise the right leg. To convert from bilateral "mode" to unilateral "mode," the set screw in one of the collars 86 would first have to be loosened and the collar 86 removed. Then, the adjacent foot pad assembly 84 would be removed. Set screws 85 would be loosened and rod 78 removed. The process would then basically be reversed, using rod 93 and only one of the leg pad assemblies 84. FIG. 3B shows the resulting structures in section.

It should be noted that seat pad 22, backrest pad 24 and leg pads 90 should be resilient for user comfort, but also quite firm in order to absorb forces generated by the body without allowing the knee joint to be displaced or relocated significantly. Also, referring in particular to FIG. 8, the seat bottom and backrest angles with respect to ground/floor, and with respect to each other, are important for comfort, lower back support, and pelvic tilt.

A preferred electrical system for machine 10 is described in some detail in commonly-owned U.S. patent application Ser. Nos. 903,297 and 675,366, filed on Sept. 2, 1986 and Nov. 27, 1984, respectively, incorporated herein by reference, and therefore an extensive description of the electrical system is not required. However, for the sake of completeness the electrical system will be briefly described.

As shown in FIG. 1, a power supply box 100 is mounted to the rear subframe 16 beneath seat 22. Power supply 100 is connected to a 115 volt AC source 102 through an on/off switch 104. Within power supply box 100 is a controllable DC power supply suitable for selectively applying 0 to 24 volts DC and 0 to 1½ amps DC to the stator windings of brake 44, according to the desired resistance selected by the user. A controller 106 determines the amount of DC current provided by power supply box 100 to brake 44. Controller 106 includes a microprocessor which ultimately controls power transistors within power suppply box 100 to modulate the DC power supplied to the stator windings of brake 44. Various switches and keypads can be supplied on the front surface of controller 106 for allowing the user to set the effort level or force provided by brake 44 depending upon the physical fitness of the user, for example. Controller 106 preferably permits the user to select a first torque setting for leg extension and a second torque setting for leg flexion or curl. This allows the user to set or "tailor" the force levels in each half-cycle to the strength of the muscle groups being exercised in that particular half-cycle. As well known to those skilled in the art, quadriceps are among the strongest muscles in the body and are typically 50% to 60% stronger than the hamstrings. Thus, it is desirable to be able to individually adjust the extension and flexion resistance. During exercise, controller 106 monitors operation and provides the user with convenient displays of the number of repetitions of the exercise cycle per minute, total number of repetitions per session, rate of energy expended per hour and the cumulative total energy expended during the session. Controller 106 is connected to power supply box 100 using conventional cabling and power supply box 100, or rather the power transistors thereof, are similarly connected to brake 44. An optical encoder (not shown) housed within brake 44 provides data to controller 106 indicative of the position of exercise arm 106 and its direction, so that controller 106 knows when to switch from extension torque to flexion torque, and vice versa.

FIGS. 4, 5 and 6 illustrate machine 10 in use. Electrical power is supplied to machine 10 by engaging rocker switch 104 located on power box 100. By doing so, controller 106 is also activated and ready to receive commands from the user, and power supply 100 is ready to controllably supply power to brake 44.

Next, adjustment pin 28 is removed and backrest 24 is slid fore or aft to the desired position. Pin 28 is then reinstalled to lock backrest 24 in the chosen position.

The leg pad support 70 can then be adjusted for the comfort of the individual. Spring-loaded pin 76 is pulled outward to disengage leg pad support 70 from exercise arm 68. Leg pad support 70 is then longitudinally adjusted to the desired position and pin 76 is released into the selected hole in exercise arm 68 to lock the adjustment.

Straps 91, 34 and 36 are secured about the lower legs, knees and hips, respectively. As noted above, preferably these straps include hook-and-loop connectors so that adjustment and readjustment can be rapidly accomplished. FIG. 4 shows the preferred alignment of the knee joints with the centerline of brake/transmission assembly 42.

The user then presses various keys on controller 106 to select the desired extension and flexion resistances. For example, the user may select 100 foot-pounds extension resistance and 50 foot-pounds flexion resistance. The repititions and resistance can be varied to achieve a broad range of objectives. If a specific range of motion is desired, this may be set by positioning the arm at one desired limit, pressing a "limit range" key, pressing a "set range" key, and moving the arm through one "rep" or cycle. Then, as the exercise arm 68 is raised and lowered a beeper within controller 106 will sound when each limit is reached. This "soft" range of motion limit is described in U.S. patent application Ser. No. 903,297, filed Sept. 2, 1986, incorporated herein by reference.

As noted above, machine 10 preferably includes a long rod 78 and a short rod 93 for bilateral and unilateral exercising, respectively. For unilateral exercise, i.e. one side only, it is necessary to replace long rod 78 with short rod 93, as described above.

A preferred embodiment of the invention is described above. Those skilled in the art will recognize that many embodiments are possible within the scope of the invention. Variations and modifications of the various parts and assemblies can certainly be made and still fall within the scope of the invention. Thus, the invention is limited only to the apparatus and method recited in the following claims, and equivalents thereto.

We claim:

1. A leg exercise machine comprising:
(a) a frame;
(b) a first leg pad;
(c) a second leg pad;
(d) a resistance unit operatively connected to the frame;
(e) an exercise arm for supporting the leg pads; and
(f) a planetary drive transmission between the exercise arm and the resistance unit, whereby the planetary drive transmission amplifies the torque provided by the resistance unit, wherein the resistance unit comprises an electromagnetic resistance unit comprising a stator connected to the frame and a rotor rotatably coupled to the stator; and the planetary drive transmission comprises a sun gear to which the rotor is connected, a plurality of planet gears rotatably connected to the exercise arm, and a ring gear fixed to the stator.

2. The exercise machine of claim 1, wherein the torque provided by the electromagnetic resistance unit is multiplied by the planetary drive transmission by a factor of between about 3 and 8.

3. The exercise machine of claim 1, wherein the torque provided by the electromagnetic resistance unit is multiplied by the planetary drive transmission by a factor of about 5.

4. The exercise machine of claim 2, wherein the electromagnetic resistance unit provides up to about 50 to 100 foot-pounds of torque and the electromagnetic resistance unit in combination with the planetary drive transmission provides up to about 150 to 800 foot-pounds of torque.

5. The exercise machine of claim 3, wherein the electromagnetic resistance unit provides up to about 80 foot-pounds of torque and the electromagnetic resistance unit in combination with the planetary drive transmission provides up to about 400 foot-pounds of torque.

6. The exercise machine of claim 1, wherein the electromagnetic resistance unit is side mounted on the frame, and the exercise arm is substantially L-shaped with a portion lying in the exercising individual's midsaggital plane and a portion perpendicular thereto.

7. A leg exercise machine comprising:

(a) a frame;

(b) a first leg pad;

(c) a second leg pad;

(d) an electromagnetic resistance unit comprising a stator connected to the frame and a rotor rotatably coupled to the stator;

(e) an exercise arm extending from the rotor of the electromagnetic resistance unit forming a plurality of longitudinally-aligned apertures;

(f) a leg pad support slidably mounted on the exercise arm;

(g) a spring-loaded pin carried by the leg pad support and suitable for selectively engaging the exercise arm apertures, whereby the leg pad support can be longitudinally adjusted by withdrawing the spring-loaded pin from one of the exercise arm apertures, relocating the leg pad support, and allowing the spring-loaded pin to engage another one of the exercise arm apertures;

(h) a pair of rods suitable for extending laterally from the leg pad support, one of the rods being suitable for supporting both of the leg pads, for bilateral exercising, and one of the rods being suitable for supporting one of the leg pads, for unilateral exercising, wherein the leg pads are slidable on the rods and can freely move laterally with respect to the exercise arm; and (i) a planetary drive transmission between the exercise arm and the electromagnetic resistance unit, wherein the planetary drive transmission comprises:

(1) a sun gear attached to the rotor;

(2) a plurality of planet gears rotatably connected to the exercise arm; and (3) a ring gear fixed to the stator, whereby the planetary drive transmission amplifies the torque provided by the electromagnetic resistance unit by a factor of 5.

8. A leg exercise machine comprising:

(a) a frame;

(b) a first leg pad;

(c) a second leg pad;

(d) means operatively connected to the frame for providing leg exercise resistance;

(e) an exercise arm operatively connected to the resistance providing means;

(f) rod means for carrying one of the leg pads;

(g) rod means for carrying both of the leg pads; and (h) means operatively connected to the exercise arm for selectively carrying either of the rod means, wherein when both of the leg pads are carried bilateral exercising is accommomdated and when only one of the leg pads is carried the exercise machine is configured for unilateral exercising, and wherein the leg pad or pads can freely float laterally on the corresponding rod means with respect to the exercise arm as the leg exercise machine is being used, and the length of the rod means on which the leg pad or pads can freely move is substantially larger than the width of the leg pad or pads, whereby the leg pad or pads automatically adjust to accommodate various hip widths and relieve lateral pressure on the exercising individual's knee or knees.

* * * * *